United States Patent [19]

Nakano

[11] 4,180,819

[45] Dec. 25, 1979

[54] DIPOLE ANTENNA STRUCTURE

[75] Inventor: Masao Nakano, Tokyo, Japan

[73] Assignee: General Research of Electronics, Inc., Tokyo, Japan

[21] Appl. No.: 812,572

[22] Filed: Jul. 5, 1977

[51] Int. Cl.[2] ..... H01Q 9/16

[52] U.S. Cl. ..... 343/792; 343/856

[58] Field of Search ..... 343/715, 749, 791, 792, 343/856, 790

[56] References Cited

U.S. PATENT DOCUMENTS

| | | | |
|---|---|---|---|
| 2,492,404 | 12/1949 | Streib et al. | 343/791 |
| 3,172,109 | 3/1965 | Senrui | 343/749 |
| 3,259,901 | 7/1966 | Bykerk | 343/749 |
| 3,588,903 | 6/1971 | Hampton | 343/792 |

FOREIGN PATENT DOCUMENTS

| | | | |
|---|---|---|---|
| 1267291 | 5/1968 | Fed. Rep. of Germany | 343/702 |
| 2154651 | 5/1973 | Fed. Rep. of Germany | 343/702 |

*Primary Examiner*—Eli Lieberman

*Attorney, Agent, or Firm*—Wallenstein, Spangenberg, Hattis & Strampel

[57] ABSTRACT

A preferably vertically oriented dipole antenna structure comprises a downwardly extending coaxial cable-like connector at the bottom of the structure attached to and insulated from a dipole element-forming sleeve whose upper end is rigidly connected to an insulating housing. The upper end of the housing supports a dipole element-forming rod extending vertically upwardly therefrom. The coaxial cable-type connector includes an outer rotatable conductive sleeve extending coaxially of the dipole element-forming sleeve and a central downwardly extending plug-in pin, the sleeve and the plug-in pin being coupled and connected to a cable extending through the dipole element-forming sleeve to a point within the insulating housing where a pair of cable conductors make connection to inductive coupling means for coupling signals between said conductors and the inner ends of the dipole element-forming sleeve and rod.

4 Claims, 4 Drawing Figures

DIPOLE ANTENNA STRUCTURE

BACKGROUND OF INVENTION

This invention relates to antenna structures having a particular, but not their only, application to vertical dipole antenna structures attachable to the upper wall of the housing of a hand carried portable transmitter-receiver on the outside of a vehicle like an automobile or the like. Most antenna structures used particularly with hand portable transmitter-receivers comprise a single vertical rigid rod or a telescoping antenna element constituting one half of a dipole antenna structure. Monopole antenna structures are commonly used for hand portable transmitter-receivers and automobile applications, where the antenna structures are commonly supported at the bottoms thereof by a downwardly extending coaxial cable-like connector which fits within a complimentary connector on the top of a housing of a portable transmitter-receiver or the automobile body involved. This type of antenna structure does not lend itself to a vertical dipole antenna configuration, which comprises two vertically spaced dipole elements and a pair of conductors connected or coupled to the confronting inner ends thereof.

The present invention uniquely applies some of the features of the dipole antenna structure disclosed in West German Pat. No. 755,066 granted June 15, 1953 to vertical dipole antenna structures mountable upon the top of the housing of portable transmitter-receivers and automobiles. The dipole antenna structure disclosed in this patent is not suitable for these applications without substantial modifications of the kind incorporating the features of the present invention. More specifically, the present invention provides a rugged vertical dipole antenna structure which can be manufactured at a reasonable cost and which is mountable in the manner of conventional vertical monopole antenna structures upon the housing of portable transmitter-receivers, automobiles and the like.

SUMMARY OF THE INVENTION

In accordance with one of the features of the present invention, assuming that the dipole antenna structure is vertically oriented, the structure comprises preferably a coaxial cable-like connector at the bottom thereof including a vertically extending outer rotatable internally threaded sleeve and a rigid plug-in pin extending vertically downwardly therefrom. An insulating sleeve is rigidly interposed between the upper end of the coaxial cable-like connector and a bipole element-forming sleeve extending vertically upwardly from the insulating sleeve. The upper end of the dipole element-forming sleeve makes a rigid connection with the bottom portion of an insulating housing. An insulated cable preferably extends between the coaxial cable-like connector and the interior of the insulating housing, the insulated cable having a pair of conductors respectively connected to said outer connector sleeve and the connector plug-in pin. The housing contains a transformer or other inductive coupling means for coupling the upper ends of said conductors extending from the coaxial cable-like connector with the aforementioned dipole element-forming sleeve and a dipole element-forming rod rigidly anchored at the upper end of the insulating housing and extending vertically upwardly thereform. There is thus formed a rugged dipole structure which is easy to mount.

Various specific features of the invention deal with the specific manner in which the parts of the antenna structure just described are constructed and interconnected to form an easy to assemble structure.

The above and other features and advantages of the invention will become more apparent upon making reference to the specification to follow, the claims and the drawings.

DESCRIPTION OF THE EXEMPLARY EMBODIMENT OF THE INVENTION

Figure 1:
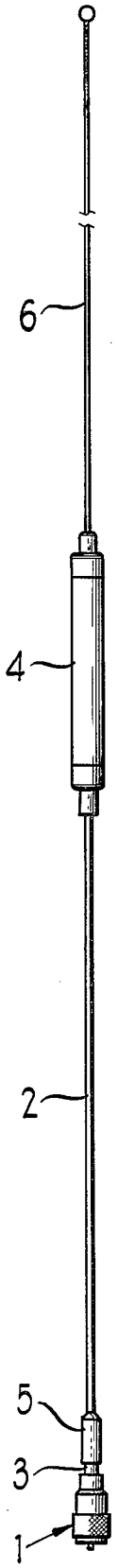
FIG. 1 is a vertical elevational view of the dipole antenna structure of the present invention.

The dipole antenna structure in FIG. 1, shown in its usual normal vertical orientation, has a downwardly extending coaxial cable-like connector 1 at the bottom end thereof adapted to be interfitted with a suitable upwardly extending complementary connector (not shown) which would be mounted on the top of a transmitter-receiver housing, automobile body or the like. The antenna structure above the connector 1 includes an insulating sleeve 3 having its bottom end anchored to the upper end of the connector 1, a connector 5 which rigidly interconnects the upper end of the insulating sleeve 3 with the bottom end of a dipole element-forming sleeve 2, and an insulating housing 4 whose bottom end is rigidly secured to the upper end of the dipole element-forming sleeve 2. Extending rigidly upwardly from the upper end of the insulating housing 4 is a dipole element-forming rod 6 removably anchored in a manner to be described, so that the dipole element-forming rod 6 can be disconnected from the housing for more compact storage or shipment thereof. The insulating housing 4 contains suitable means for coupling the conductors of the connector 1 to the inner ends of the dipole element-forming sleeve 2 and the dipole element-forming rod 6. This coupling means may comprise a transformer 8 shown diagrammatically in FIG. 4.

Figure 4:
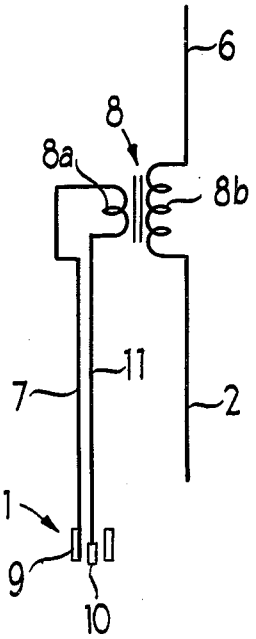
FIG. 4 is a circuit diagram of the electrical portions of the antenna structure of FIGS. 1 and 2.

The connector 1 is shown in a coaxial cable-type connecttor having a downwardly extending outer rotatable internally threaded cylindrical metal sleeve 9 threadable around an externally threaded connector (not shown) to which the antenna structure is to be physically and electrically connected. The connector 1 further has a rigid downwardly extending central pin 10 which fits within a socket of the latter connector (not shown) to which the antenna structure is physically and electrically connected. As shown in FIG. 4, conductors 7 and 11 respectively couple the connector sleeve 9 and the rigid pin 10 to the outer ends of transformer winding 8*a*. The transformer 8 is shown having a winding 8*b* inductively coupled to the winding 8*a* and connected to the inner ends of the dipole element-forming sleeve 2 and the dipole element-forming rod 6. The various parts of the dipole antenna structure just broadly described can be constructed and interfitted together in a number of ways in accordance with the broadest aspects of the invention. However, in accordance with the preferred form of the invention, the parts are preferablly constructed and interfit in the manner now to be described.

Figure 3:
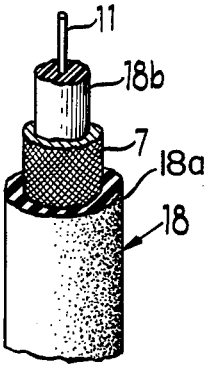
FIG. 3 is a greatly enlarged fragmentary sectional view through the insulated cable which interconnects the coaxial cable-like connector at the bottom of the antenna structure of FIG. 1 with inductive coupling means contained within the insulating housing forming part of the antenna structure of FIG. 1.

The connector sleeve 9 has a bottom internally threaded portion 9*a* terminating in an unthreaded intermediate portion 9*b*. The intermediate portion defines a cylindrical space 9*b*′ terminating in a downwardly axially facing shoulder 9*c*. The sleeve 9 is rotatably mounted with respect to an inner connector assembly 14 having a main metal body 13 having a narrow externally threaded flange 13*a* located within the space 9*b*′ of the sleeve 9 which flange is initially threadable into the internally threaded bottom portion 9*a* of the sleeve 9 where it passes into the sleeve space 9*b*′. When the sleeve 9 is tightened over the receiving connector (not shown), the sleeve shoulder 9*c* is pulled into engagement with the metal body flange 13*a*. The connector metal body 13 further includes a bottom outer cylindrical portion 13*b* surrounding an insulating member 15 enclosing the pin 10. The pin 10 terminates at a point within the insulating member 15 where the central conductor 11 of a cable 18 (FIG. 3) is soldered or otherwise physically and electrically connected to the pin. The cable 18 passes into an opening 13*c* in the metal body 13.

The cable 18 also has an outer layer 18*a* of insulating material surrounding a sheath of braided wire acting as the aforesaid conductor 7, in turn, surrounding an insulation sheath 18*b* which surrounds the central conductor 11. The sheath 7 of braided wire is bared at the lower end of the cable to engage the metal connector body 13 to which it may be soldered.

The connector body 13 has an upper externally threaded cylindrical portion 13*d* around which extends and is threaded the insulating sleeve 3. The insulating sleeve 3 is rigidly anchored to the interior of the cylindrical metal connector member 5 having an upper portion 5*a* over which the bottom end portion of the dipole element-forming sleeve 2 is connected as by staking or the like.

The upper end of the dipole element-forming sleeve 2 is anchored as by staking it around the lower neck portion 26*a* of a metal bushing 26. The bottom end portion 4*a* of the housing 4 has a skirt 39 into which the upper end portion of the dipole element-forming sleeve 2 extends and is rigidly connected as by a tight press fit therebetween. The bushing 26 has an externally and internally threaded cylindrical upper portion 26*b* over which the bottom end portion 4*a* of the insulating housing 4 is threaded. The upper portion 26*b* of the bushing 26 receives the externally threaded portion 30*a* of the metal bottom end portion of a coil support bobbin 30. The bobbin has a main body portion 30*b* of insulating material and terminates at its upper end in an externally threaded metal portion 30*c* which is threaded into the downwardly opening internally threaded bottom portion 32*a* of a metal bushing 32, which bottom portion is externally threaded to receive a closure cap 4*b* of the housing 4. The bushing 32 has an upwardly projecting neck portion 32*b* having an upwardly opening threaded aperture 32*b*′ which receives the threaded bottom end portion of the dipole element-forming rod 6. The main body portion 4*c* of the housing 4 is a cylindrical member fitting around the reduced upper end 33 of the bottom end portion 4*a* of the housing and around the reduced bottom end 35 of the closure cap 4*b*, which holds together the entire assembly of the parts just described when it is tightly threaded around the bushing 32.

Figure 2:
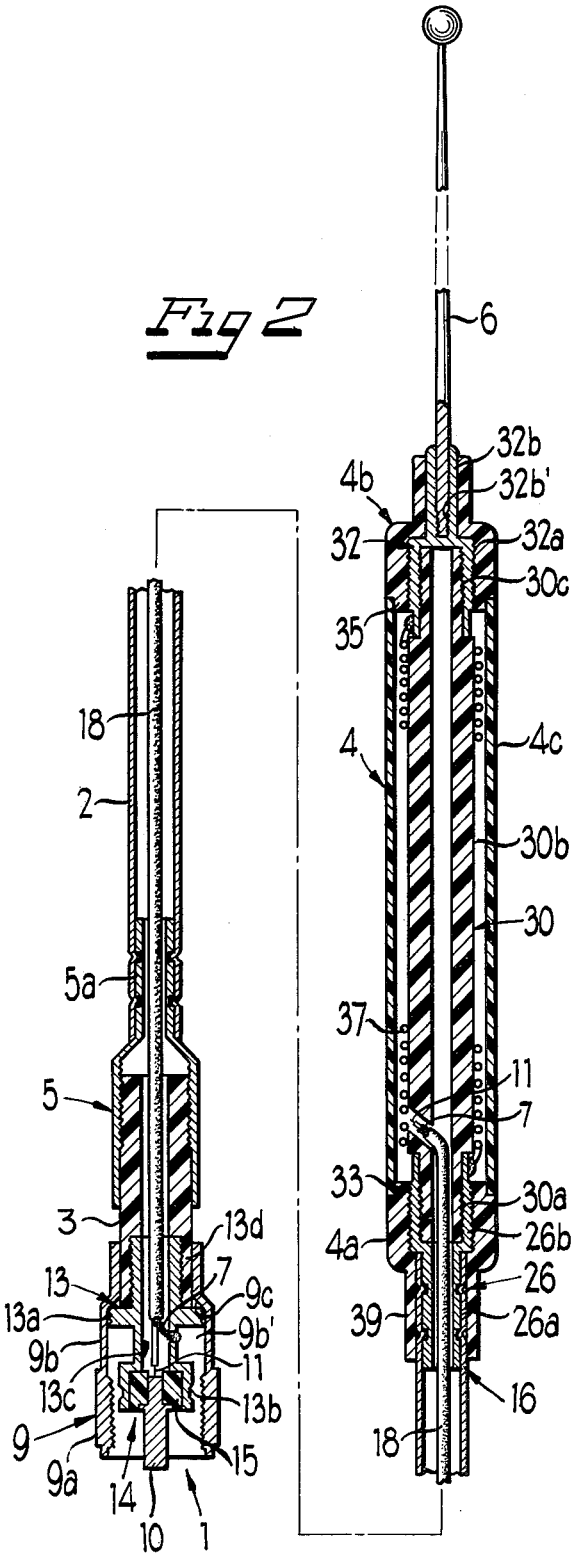
FIG. 2 is a partly broken-away, enlarged, longitudinal sectional view through the dipole antenna structure of FIG. 1.

The main body portion 30*b* of the coil support bobbin 30 supports on the outside thereof coils of wire 37 forming a suitable inductive coupling like the windings 8*a*–8*b* of transformer 8 shown in FIG. 4. In such case, the braided wire of the insulated cable 18 acting as the conductor 7 in FIG. 4 makes connection with one end of the coil of wire forming the winding 8*a*, and the end of the central conductor 11 of the cable 18 makes connection with the other end of this winding 8*a* in any suitable way, as by solder connections within the housing 4. The main body portion 30*b* of the bobbin has an aperture 39 shown in FIG. 2 through which the upper end portion of the cable 18 passes to gain access to the coils of wire 37. The coils of wire forming the winding 8*b* may be soldered respectively to the exposed end portion of the metal bushings 26 and 32.

It should now be apparent that the present invention provides a very rugged, easy to assemble and service antenna structure which can be easily mounted and anchored securely in place to form a relatively compact dipole antenna structure. Also, it should be understood that numerous modifications can be made in the preferred form of the invention described without deviating from the broader aspects of the invention.

I claim:

1. A vertical dipole antenna structure comprising, in combination: a vertically extending connector at the bottom of the structure and having a pair of downwardly extending connector elements adapted to interfit with complementary upwardly extending connector elements of a support for the antenna structure, a vertically extending insulating sleeve having its bottom portion rigidly connected to the upper end of said connector and its upper portion rigidly connected to the bottom portion of a vertically extending dipole element-forming sleeve, an insulating housing secured to the upper end of said dipole element-forming sleeve, a conductive dipole element-forming rod anchored at the upper portion of said housing and extending vertically upwardly therefrom, a pair of signal carrying conductors having their lower ends respectively connected to said pair of connector elements and passing through said dipole element-forming sleeve in insulated relation thereto, signal coupling means coupling the other end of said pair of conductors respectively to the inner ends of said dipole element-forming sleeve and rod, said insulating housing having bottom and intermediate portions and a cap portion, a coil support bobbin in said housing on the outside of which bobbin are coils of wire forming said signal coupling means, the bobbin terminating in a conductive end portion at the bottom end thereof to which the upper end of said dipole element-forming sleeve and said coils are physically and electrically connected, the upper end of said bobbin having a conductive end portion thereon to which said dipole element-forming rod and coils are physically and electrically connected, and said cap portion being threadedly securable at the upper portion of said bobbin so as to hold together the assembly of said bobbin and the bottom and intermediate portions of said housing.

2. The dipole antenna structure of claim 1 wherein said dipole element-forming rod is removably secured to the upper conductive end portion of said bobbin so that the rod may be detached from the housing for compact storage and shipment with the other portion of the antenna structure.

3. The dipole antenna structure of claim 1 wherein there is provided a bushing which removably interconnects and receives said conductive end portion at the upper end of said bobbin and said dipole element-forming rod.

4. The dipole antenna structure of claim 1 wherein there is provided a bushing to which the upper end of said dipole element-forming sleeve is permanently anchored and to which the conductive end portion at the bottom end of said bobbin is removably connected.

* * * * *